US006505573B1

(12) United States Patent
Sheikholeslam et al.

(10) Patent No.: US 6,505,573 B1
(45) Date of Patent: Jan. 14, 2003

(54) TOWROPE RETRIEVER FOR WATERCRAFT

(76) Inventors: Sherwin Sheikholeslam, 5800 Arboretum Dr., Los Altos, CA (US) 94024; Jerry M. Schoening, 5800 Arboretum Dr., Los Altos, CA (US) 94024; Matthew T. Hayduk, 76 Robinson Ave., Glen Cove, NY (US) 11542

( * ) Notice: Subject to any disclaimer, the term of this patent is extended or adjusted under 35 U.S.C. 154(b) by 0 days.

(21) Appl. No.: 09/904,054

(22) Filed: Jul. 12, 2001

(51) Int. Cl.[7] ..... B63B 21/16
(52) U.S. Cl. ..... 114/254
(58) Field of Search ..... 114/247, 253, 114/254

(56) References Cited

U.S. PATENT DOCUMENTS

| | | | | |
|---|---|---|---|---|
| 3,100,606 | A | | 8/1963 | Nicholson |
| 3,178,127 | A | * | 4/1965 | Andersen ..... 114/253 |
| 3,547,371 | A | | 12/1970 | Gruseck |
| 3,643,886 | A | | 2/1972 | Colton |
| 3,738,589 | A | | 6/1973 | Brayman |
| 3,919,963 | A | * | 11/1975 | Cox, III ..... 114/253 |
| 3,964,425 | A | | 6/1976 | Septor, Sr. |
| 4,133,496 | A | | 1/1979 | Zetah |
| 4,274,605 | A | | 6/1981 | Gruber, Jr. |
| 4,356,557 | A | | 10/1982 | Bell et al. |
| 4,624,141 | A | | 11/1986 | Soleau |
| 5,119,751 | A | | 6/1992 | Wood |
| 5,341,758 | A | | 8/1994 | Strickland |
| 5,632,219 | A | | 5/1997 | Fleming, Jr. |
| 5,694,337 | A | | 12/1997 | Macken |
| 5,732,648 | A | | 3/1998 | Aragon |
| 5,794,883 | A | | 8/1998 | MacEwen |
| 5,906,170 | A | * | 5/1999 | Robertson ..... 114/254 |
| 5,943,977 | A | | 8/1999 | Womack et al. |
| 5,979,350 | A | | 11/1999 | Larson et al. |
| 6,044,788 | A | | 4/2000 | Larson et al. |
| 6,138,397 | A | | 10/2000 | Hammersland et al. |
| 6,192,819 | B1 | | 2/2001 | Larson et al. |

* cited by examiner

*Primary Examiner*—Jesus D. Sotelo
(74) *Attorney, Agent, or Firm*—Intellectual Property Law Group LLP; Otto O. Lee; Takashi Hashimoto

(57) ABSTRACT

A towrope retriever system for a watercraft for simplifying and improving the safety of the towrope handling, storage, reeling out, and reeling in of a towrope, in which the towrope retriever is connected to or integrated into a support unit such as a tower or pylon securely attached to the watercraft, substantially increasing the overall height of the watercraft, and allowing the performer to jump higher and perform more challenging aerial maneuvers, is disclosed. The towrope retriever may be rotatable to allow the performer a greater flexibility of movement and may be easily removed for storage.

18 Claims, 4 Drawing Sheets

TOWROPE RETRIEVER FOR WATERCRAFT

BACKGROUND

This invention relates generally to water sports and specifically relates to water skiing and wakeboarding.

Wakeboarding is a water sport that is becoming increasingly popular worldwide. As more enthusiasts take up the sport, the demand for a greater variety of equipment is continuously growing. By attaching their towrope to a 5–10 foot support member such as a tower or pylon mounted on the watercraft, wakeboarders can jump higher and perform more challenging aerial tricks. Different towrope lengths are required for various wakeboard/water ski tricks, styles, and skill levels.

Towers are patented under the name "water sports towing apparatus" and are available in many configurations and applications. The tower normally has a towrope attachment means mounted to the uppermost, rearmost portion of the structure, commonly called a "knob." Pylons are a pole of various sizes, mounted in the watercraft in various positions with the axis of the pole vertically oriented, and may or may not be supported by cables attached to the watercraft to support the load. The pylon also has a knob on the uppermost end of it. The knob on the tower or pylon may be as high as ten feet from the floor of the watercraft, requiring someone to climb on the watercraft to reach it. The towrope, in current practice, has a loop at the end of it, and loops in several places along its length, which are secured to the watercraft by placing the desired loop over the knob on the tower or pylon.

In the current practice of wakeboarding and/or water skiing, the tow towrope is released, retrieved or adjusted in length or stored manually by a person in the watercraft. The purpose of this invention is to simplify and improve the safety of the towrope handling, storage, reeling out, reeling in tasks by automating these tasks and allowing the remote operation of a device by the driver or other designated operator of the device.

Towropes are made in various configurations, with various materials, and various constructions. Loops are normally provided in the towrope at various lengths to allow the performer to do tricks of various kinds and levels of difficulty, requiring different lengths, at the performer's discretion. Typically, the towrope will have length indicators of some kind, markers or colors, to assist the operator in selecting the desired length of towrope from the knob to the performer. When a towrope length change is desired, the watercraft must be stopped, the operator must climb to reach the top of the tower/pylon, remove the loop currently in use, select the loop at the desired length, and put that loop on the knob. This may be required in water conditions that cause the watercraft to be rocking, representing a danger to the person doing the towrope adjustment. When the towrope is adjusted to a shorter length, the unused portion of the towrope is left hanging from the knob, which may cause entanglement, or other inconveniences.

Between sessions of performer use, the towrope typically is pulled into the watercraft by one of the occupants, and must be temporarily stored until the next performer's use. Typically, this is done by piling the towrope on the floor of the watercraft, leading to kinks, knots, and other entanglements in the towrope, which cause inconvenience when the towrope is later used. Additionally, the towrope laying around on the floor of the watercraft can become entangled with the people in the watercraft, and when released for towing use can cause injury to those people. (There are recorded accidents where this was the cause of injury.) When a towrope with knots and tangles is being released from the watercraft, with a skier on the handle end, and the watercraft pulling on the other end, sometimes a person in the watercraft is attempting to untangle the towrope at the same time as the towrope is being pulled tight between the watercraft and the skier. There are recorded incidents of injuries involving the severing of fingers that result from this unsafe condition.

After the day's activities, the towrope must be stored for future use. Normally this is done by coiling the towrope manually by one of the watercraft occupants and putting it into some storage compartment or location. Improper coiling can also lead to kinking and knots during future use.

Water sports towing operations regulations require that there be a watercraft driver and a separate observer to notify the driver when the performer has fallen or wants a change of speed, towrope length, etc. In addition someone in the watercraft is normally assigned to handle the duties of towrope management—pulling the towrope in, adjusting the length, letting out the towrope, etc. There is also a regulatory requirement in many states for an assignment of the duty to raise a flag when the performer is in the water to warn other watercrafts of the dangers of the performer in the water and the tow towrope trailing the watercraft in the water. These various tasks for the occupants/operator/driver, combined with the normal fun of the sport, lead to confusion and mistakes in the handling of the towrope leading to unsafe conditions and actions.

If a more automated method of handling the towrope were used, it would reduce the work load on the watercraft crew and reduce the probability of towrope kinks and entanglements, trips and falls and other injuries while adjusting towrope lengths, etc. and allow the driver and crew to focus more on other duties.

At the beginning of an activity, the performer enters the water from the back or side of the watercraft when the watercraft is stationary in the water and the engine is off or in neutral so there is no danger of contact with the propeller. Once the performer is in the water, someone in the watercraft will hand the towrope end to him/her, and the performer will swim away from the watercraft, carrying the towrope with him/her. A flag must be raised at this time. When a safe distance is established, the driver will engage the propeller and move the watercraft slowly away from the performer until the towrope is fully extended at the desired, preset length. The towrope is released from the storage location (mainly a pile on the floor of the watercraft) as the distance from the watercraft increases and someone in the watercraft must manage this to eliminate any kinks, tangles, knots, etc. When the towrope is fully extended, and the performer is ready, the driver applies power and the performer is pulled out of the water to begin the performance. If there are knots and tangles in the towrope, and someone in the watercraft attempts to straighten them out at this time, there is a high probability of their injury.

The performer will continue doing tricks until tired or until a fall occurs. When the performer is back in the water, the flag must be raised, and the watercraft occupants must manage the towrope. The towrope will be 1) pulled in, if the performance is over; 2) adjusted in length if performer requests it; 3) pulled back into position by the watercraft if the performer wishes to continue with the towrope at the existing length. If a change in length is requested, the towrope loop currently engaged on the knob must be removed, the towrope pulled in or released out to the desired length, and the new loop engaged on the knob. If the performance of that performer is finished, the towrope will be pulled into the watercraft and the performer picked up.

Problems related to the towrope length adjustment, manually pulling in and letting out the towrope, and storage of the towrope on the floor of the watercraft, have been noted throughout the history of the sport. People become entangled in the towrope, the towrope becomes kinked and knotted, and towrope length adjustment is an inconvenient and unsafe task in the watercraft during the practice of the sport.

A number of towrope retrievers have been devised but never successfully marketed for both water skiers and wakeboarders. The majority of retrievers were designed with the water skier in mind and thus failed to meet the differing needs of wakeboarders. Conventional retrievers are rigidly mounted and not rotatable on their axis, and are designed for permanent mounting on the rear, or in the hull of a water ski towboat. Wakeboarders find this undesirable as the typical mounting position low in the watercraft does not allow them to perform the highest jumps, and because the rigid reel cannot track the direction of the wakeboarder. This type of towrope retriever is either non-removable or difficult to remove and store.

Existing designs of retrievers are not designed to be attached to a 5–10 foot tower. Adjusting the length of the towrope is equally difficult with current retrievers. Most designs either have no means for measuring out a precise length of towrope, or the means to do so is not easily adaptable for use in conjunction with a wakeboarder's tower or pylon.

The need for a towrope retrieval system that can be mounted on a wakeboarder's tower or pylon with rope exit at the knob location and track the movements of the wakeboarder is apparent. Equally clear is the need for a motorized towrope mechanism that can easily and precisely adjust the length of the towrope. A number of towrope retrieving devices have been devised but the majority of these devices are based on a design in which the device is fixed to the stern or lower hull of the watercraft. For example, there are retrieving devices designed to automatically rewind the towrope onto a spool or reel once it has been released by the water skier. One such device achieves this result using a spring operated retrieval mechanism fixed to the rear of the watercraft to automatically coil up the towrope after its release, while the other is similarly attached to the rear of the watercraft but uses a reverse polarity motor to automatically retract the line.

Another retrieving device consists of a housing enclosing a motor and an exposed drum or shaft. However, the device is also mounted on the rear of a watercraft. The housing contains a recess through which the shaft extends and into which a reel with an attached operating handle is inserted to hold the towrope.

Another towrope retriever is fixed to the hull of the watercraft, and it reels in or lets out towrope to adjust the length while the skier is performing. This retriever uses a heavy-duty winch to slowly pull in the towrope to a specified length, which is detected by a separate measuring device. These adjustments are controlled using a module mounted onto the dash of the watercraft.

A common feature of these devices is that they are all mounted to the lower hull of the watercraft and are large, heavy devices unsuitable for mounting on a tower or pylon. This limits the height of the jumps wakeboarders can perform and makes tracking the direction of the wakeboarder impossible. Thus, there is a need for a compact and lightweight towrope retrieval system consisting of a unit that can be mounted on a wakeboarder's tower and may be capable of rotating to track the movements of the wakeboarder. In addition there is a need for a remote operated motorized towrope mechanism that can easily and precisely adjust the length of the towrope, and store the towrope when not in use to eliminate knots and kinks, and to improve safety of operations. To meet the needs of wakeboarders such a device must also be designed for easy removal and storage.

SUMMARY

The present invention satisfies these needs. This invention is a towrope retriever system for a watercraft, in which the towrope retriever is connected to or integrated into a support unit such as a tower or pylon securely attached to the watercraft and substantially increasing the overall height of the watercraft allowing the performer to jump higher and perform more challenging aerial maneuvers. The retriever unit may be rotatable to allow the performer a greater flexibility of movement and can be easily removed for storage.

In a preferred embodiment, the towrope retriever has a main housing connected to the support unit; an electronic control unit; a reel for reeling a towrope having an attachment end attached to said reel and a handle end, said reel being axially mounted in the main housing; a motor operatively connected to the reel and electrically controlled by the electrical control unit for providing rotational power to the reel; and a rope holding device for securely holding the towrope at a selected length.

In an alternative embodiment, the reel is concentrically mounted on the motor.

The support unit may be a pylon being rigidly attached to the watercraft.

In another embodiment, said watercraft includes-a bow, a stern, and a starboard gunwale and a port side gunwale located between the bow and the stern, and the support unit is a tower being rigidly attached to the starboard gunwale and the port side gunwale.

Variations on motor specification and configuration are possible. The motor may be powered by electrical power supplied from a power supply on the watercraft. The motor may be capable of forward and reverse operation, or unidirectional operation. The motor may be adapted to provide reverse torque to hold the towrope in position. The motor may be capable of variable speed operation, or fixed speed operation.

The electronic control unit may include an electric speed switch to adjust rotational speed of the motor and/or an electric direction switch to adjust rotational direction of the motor.

The main housing may further include a split collar for rotatably connecting the towrope retriever to a knob on the watercraft.

The towrope retriever system could further comprise a quick release mechanism, allowing easy removal of the towrope retriever from the knob. The towrope retriever system could also comprise one or more visual length indicators placed on the towrope.

The main housing could further comprise a measurement reference point for measuring length of the towrope from said measurement reference point to the handle end.

The electronic control unit may be a wireless handheld device, or an integrated wired device.

The towrope retriever system having the reel concentrically mounted on the motor could further comprise: a safety clutch having an input side and an output side, said safety clutch being configured to be driven by the motor on said input side; a motor-to-spool drive housing being engageably connected to the safety clutch at the output side thereof and fixedly mounted onto the reel for transmitting torque from the motor to the reel; and a ratchet pawl assembly being configured to prevent motion of the reel in a reel-out direction. In such embodiment of the towrope retriever system, said ratchet pawl assembly may comprise: a solenoid, a pawl catch, a ratchet pawl, a trip lever, and a pawl spring; such that said ratchet pawl assembly prevents motion of the reel by engagement of said pawl with said ratchet wheel, whereupon the reel being driven by the motor in a reel-in direction, said ratchet moves said trip lever into engagement with said pawl catch and holds said ratchet pawl out of engagement with said ratchet wheel, thereby allowing free rotation of the reel.

In a preferred embodiment, the safety clutch may be adapted to slip when torque from the concentric motor or the concentric spool exceeds a predetermined torque setting.

The electronic control unit may include an electric release switch to release the solenoid, thereby allowing the towrope to be reeled out when pull on said towrope exceeds a predetermined clutch setting.

The electronic control unit may include an electric reel-in switch to activate the motor in a reel-in direction to disengage said ratchet pawl.

the electronic control unit may include an electric lock switch to activate said solenoid to release said ratchet pawl, such that the ratchet pawl engages and locks the reel.

The electronic control unit may include an automatic towrope length adjuster.

The towrope retriever system may further comprise a towrope length measuring device for measuring a length of the towrope being reeled out.

The towrope retriever system may also include the towrope retriever being integrated into the support unit.

DRAWINGS

FIGS. 5A–15C illustrate alternative embodiments of the motor and the reel layout design of the present invention.

DETAILED DESCRIPTION OF THE INVENTION

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
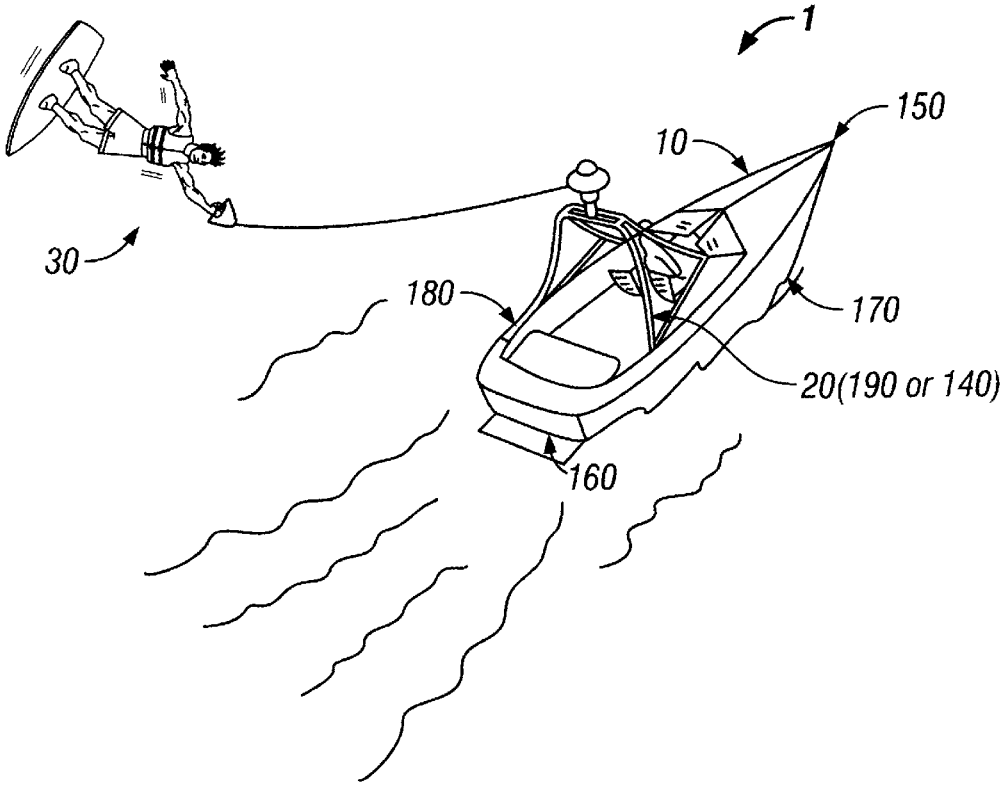
FIG. 1 illustrates one embodiment of the towrope retriever system of the present invention.

The invention is a towrope retriever system 1 for use with a watercraft 10 as illustrated in FIG. 1, wherein such watercraft can be any watercraft with sufficient power and speed to pull a water sports performer 30. The watercraft 10 may be fitted with any support unit 20 which securely attach to the watercraft, including towers, pylons, or similar devices.

The uniqueness of the towrope retriever system of the present invention lies in the mounting of the towrope retriever 40 on a support unit 20 such as a tower 190 or pylon 140 incorporating the function of automatic, powered towrope length adjustment, retrieval, and storage at the point of normal towrope attachment for wakeboarding (the top of the tower or pylon) or any other locations, with a rope exit at a knob location to allow tracking of the movements of the wakeboard performer 30. There are many ways to implement this basic concept. The choice of how to best configure the instant design is based on the relative cost of components, manufacturing costs, size of the package, and final appearance. Any of the configurations could achieve the same specifications.

Figure 2:
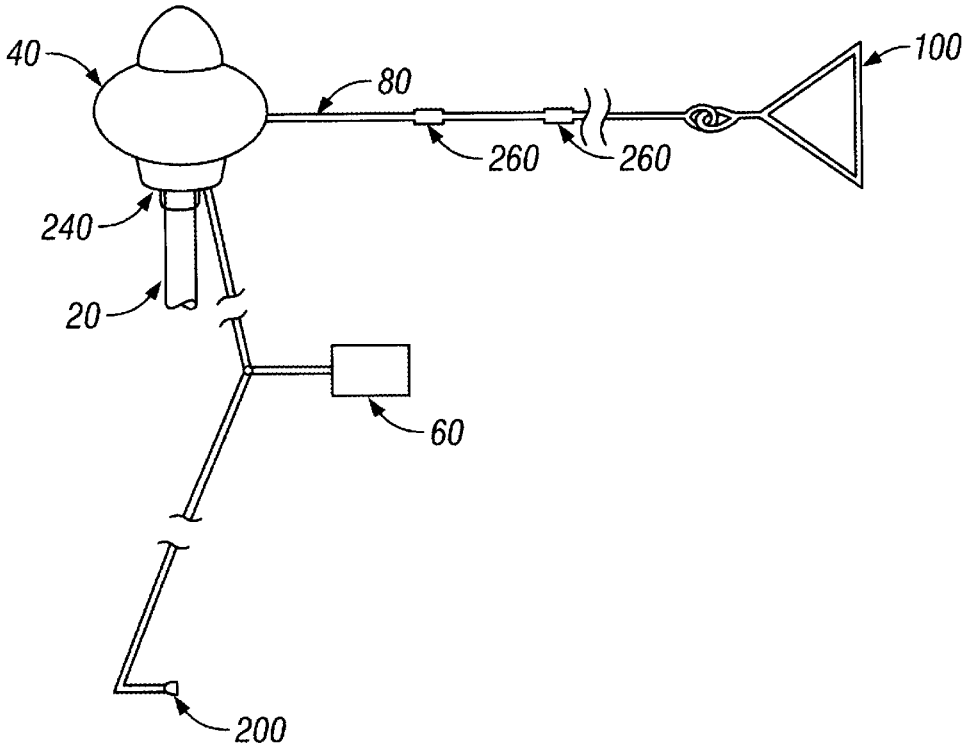
FIG. 2 illustrates a close-up view of one embodiment of the towrope retriever of the present invention being mounted on a support unit and being connected to a towrope and an electronic control unit.

The towrope retriever system as illustrated in FIG. 2 comprises a motor 110 which provides the power to turn a reel 70, the reel 70 to which a towrope 80 is connected, the towrope 80 used to tow the performer 30, a towrope holding device 120 which holds the towrope 80 securely at a selected length, a knob 240 for mounting the towrope retriever 40 on a support unit 20 which in a preferred embodiment is a tower 190 or pylon 140, an electronic control unit 60, and a torque limiting device 300 such as a safety clutch 305 (not illustrated here).

The motor 110 is electrically powered (could be AC or DC with a DC/AC converter) and may be either a variable or fixed speed motor. In addition to providing the power used to turn the reel 70, the motor 110 winds the towrope 80 in, may also be used to reel it out, and may be used to provide reverse torque to hold the towrope 80 in position, or control the maximum pull on the towrope 80. The motor 110 may be unidirectional or reversible, geared or non-geared, and may or may not have an integral clutch and/or brake.

A towrope 80 is attached to the reel 70 and is used for towing the performer 30. The reel 70 winds up the towrope 80, stores it, releases it, and adjusts its length when driven by the motor 110 or allowed to turn when the towrope 80 is pulled out by the performer 30 or others. The towrope 80 can vary in size, composition, material, total length, and cross-section. An attachment end 90 of the towrope 80 is designed to attached to the reel 70, while a handle end 100 is designed to attach to the towrope handle. In the preferred embodiment, the towrope 80 has visual length indicators 260. See FIG. 2.

In the preferred embodiment, adjusting the towrope 80 length is done using visual length indicators 260 on the towrope, with adjustments made by stopping the reel 70 at the desired place using the electronic control unit 60. Alternative embodiments adjust the length by selecting the appropriate length and measuring the extended length using any of a variety of towrope length measuring devices that measure the towrope as it is pulled through the device. In one alternative embodiment, an automatic towrope length adjuster is used in which the length is measured by a calibrated wheel through the electronic counting of the number of rotations or partial rotations, with the towrope passing over the wheel. Once the length of the towrope 80 has been adjusted, a towrope holding device 120, which is the ratchet pawl assembly 340 in the current embodiment, is used to hold the towrope 80 securely in place at a selected length. A torque limiting device, 300 a safety clutch 305 in the current embodiment, is used to limit the amount of pull on the towrope 80 and to prevent the injury of persons that may become entangled in the towrope 80. In the preferred embodiment, this is achieved by a safety clutch 305 between the motor 110 and the motor to spool drive housing 330, but this can also be achieved by the safety clutch 305 provided as part of the motor 110, or by an electronic control that senses the motor current.

An electronic control unit 60 controls the motor 110, the rope holding device 120, towrope length adjuster, etc., using electronic controls located in various manners. The functions can be on/off, in/out, speed of motor, locked/unlocked towrope, towrope length selection. The electric speed switch allows the operator to control the speed at which the length of the towrope 80 is adjusted, while the electric direction switch controls the direction in which the towrope 80 is reeled. The electronic control unit 60 can be mounted on the towrope retriever 40 or pendant hanging from the towrope retriever 40, or in the preferred embodiment can be either mounted near the driver of the watercraft with hard wire connection to the towrope retriever 40 as an integrated wired device. The electronic control unit 60 may also be a wireless handheld device carried by any person in the watercraft 10 or by the performer 30.

The towrope retriever 40 is mounted onto the support unit 20. The towrope retriever 40 mounts on the uppermost part of the support unit 20. There are many variations of towers 190 and pylons 140, and the mounting may vary depending on the specific application, and whether it is mounted by the manufacturer of the support unit 20 or added later as an accessory by the end user or dealer. In the preferred embodiment, the mount can be either rotating or fixed in position, directly on the knob 240 or in a nearby location, or securely fixed to the support unit 20 or detachable with a quick release. In an alternative embodiment, the mount could be integrated into the design of the tower 190 or pylon 140.

Figure 3A:
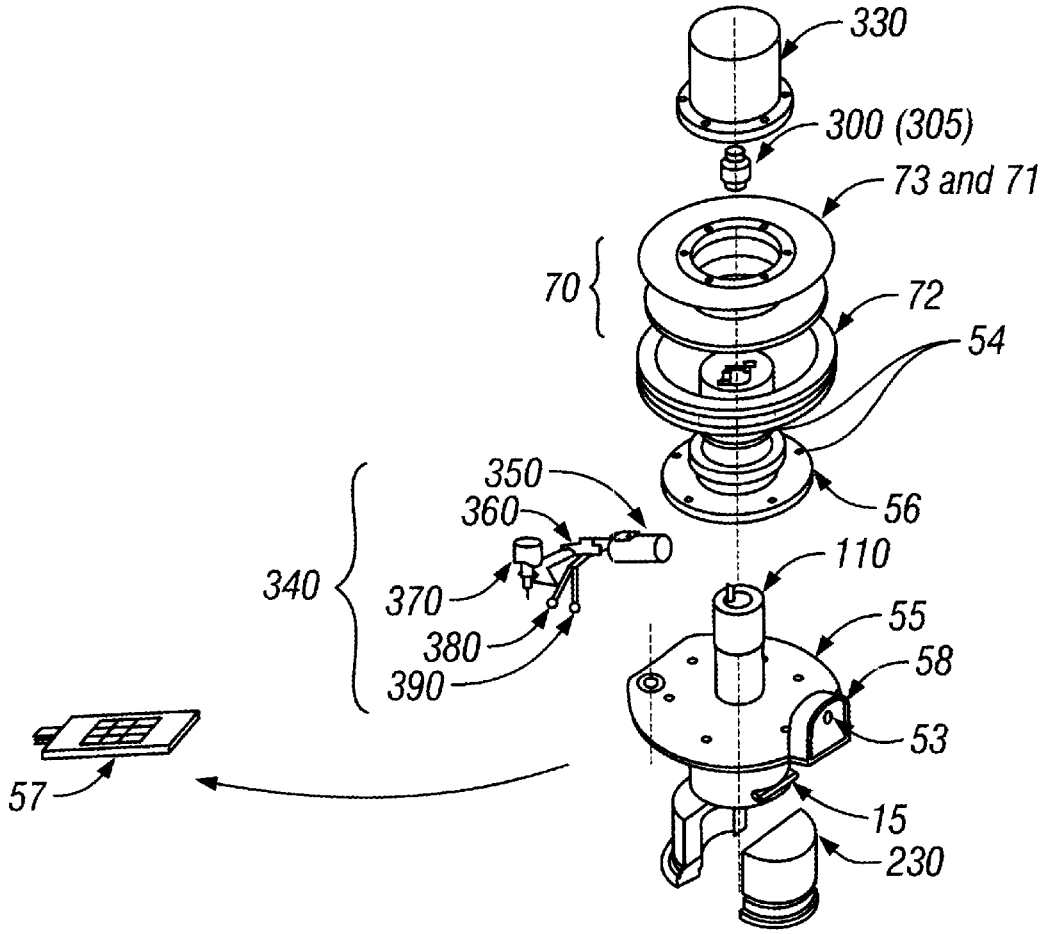
FIG. 3A illustrates a disassembled components view of one embodiment of the towrope retriever of the present invention.
Figure 3B:
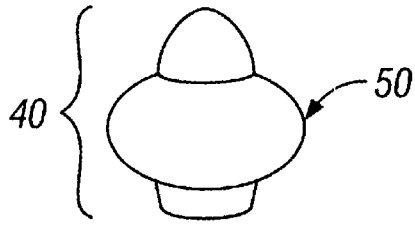
FIG. 3B illustrates one embodiment of the towrope retriever of the present invention.

In a preferred embodiment, the towrope retriever 40 has a motor 110 and reel 70 in a concentric design as in FIG. 3A and FIG. 3B. The towrope retriever 40 is attached to the watercraft's existing towrope attaching means (e.g., knob 240) on towers 190 or pylons 140 via a split collar retainer 230 made of a bearing material, which is either metallic or non-metallic. The split collar retainer 230 fits inside the main support 55 of main housing 50 and provides an outside diameter for the main support 55 to turn on and attach to. The split collar retainer 230 may be either a standard design suitable for all applications or one of several designs suited for individual applications as needed.

A structural member made from a material suitable for the level of stress serves as the main support 55, which is the means that carries the load from the reel 70 through the split collar retainer 230 to the knob 240 on the tower 190 or pylon 140. The main support 55 is held on the split collar retainer 230 by a pin 15 engaged in a groove in the split collar retainer 230. In an alternative embodiment, the retriever has a quick release mechanism that allows the retriever to be easily detached. The main support 55 serves as the mounting for the spool motor support 56, a ratchet pawl assembly 340, main housing 50, and circuit board 57. The towrope exit guide block 58 attaches to the main support 55 and provides a smooth guide for the towrope 80 as it comes from the reel 70 and also serves as the stop for the end of the towrope 80 when finally reeled in. A measurement reference point allows the length of the towrope 80 to be measured from the measurement reference point to the handle end 100.

The motor 110 is mounted to the spool motor support 56 and drives the safety clutch 305. The safety clutch 305 mounts to the motor shaft. The motor 110 is powered by a 12 V DC supplied from the watercraft power supply. Motor speed, direction, and on/off states are controlled by an electronic control unit 60 which could either be connected to the main support 55 through a wired connection 59 or wireless. The motor 110 is a gear motor with internal gear reduction and capability for forward and reverse operation as well as variable speed operation.

The spool/motor support 56 is a metal part mounted to the main support 55 to support the motor 110 and the reel 70. The motor 110 is mounted to the spool motor support 56. The spool bearings 54 are fitted to the outside diameter of the spool motor support 56 to provide a support and a means of rotation for the reel 70. The spool bearings 54 rotate around the spool/motor support 56 and provide for free movement of the reel 70. Spool bearings 54 are either ball bearings or sleeve bearings of metallic or non-metallic construction, and they may be fixedly or movably fitted.

Figure 4:
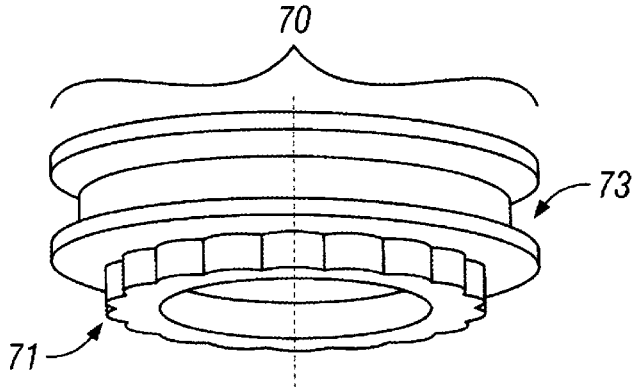
FIG. 4 illustrates one embodiment of the reel of the present invention.

The reel 70 rotates on spool bearings 54 fitted to the inside diameter of the reel 70. The reel 70 is attached to the motor to spool drive housing 330 and is driven by it. The reel 70 has the attachment end 90 of the towrope 80 end secured to it by a loop or other attachment means. The reel 70 winds up the towrope 80 or releases it by rotating in one direction or the other. The lower flange of the reel 70 has been configured to provide a ratchet wheel 71 for holding the reel 70 in a locked position when engaged with the ratchet pawl assembly 340 as in FIG. 4. When the reel 70 is turned in the direction of reeling in the towrope 80, the ratchet wheel 71 acts against the ratchet pawl 360 to cause the trip lever 370 to become engaged with the pawl catch 360 holding the ratchet pawl 380 out of engagement with the reel 70. A ratchet shield 72 is positioned between the spool 73 and the main support 55 and protects the ratchet wheel 71 on the lower flange of the reel 70 from entanglement with the towrope 80 or debris that the towrope 80 may bring out of the water when reeling in.

The safety clutch 305 is driven on the input side 310 by the motor 110 and drives the motor to spool drive housing 330 on the output side 320. The safety clutch 305 is captured in the space between the spool/motor support 56 and the motor to spool drive housing 330. The safety clutch 305 transmits torque from the motor 110 to the motor to spool drive housing 330 causing the motor to spool drive housing 330 to turn the reel 70. If resistance to turning the reel 70 when reeling in the towrope exceeds a preset amount, the safety clutch 305 slips to prevent excessive towrope pull which could injure an entangled person. When it is desired to reel the towrope 80 out, the operator releases the ratchet pawl 360 from engagement with the reel 70 and the performer 30 pulls on the towrope 80 with sufficient force to cause the safety clutch 305 to slip. The motor to spool drive housing 330 attaches to the reel 70 and is driven by the output side 320 of the safety clutch 305. The motor to spool housing 330 serves as an intermediate part transmitting torque from the motor 110 to the reel 70.

In FIG. 3A, a ratchet pawl assembly 340 which is composed of the solenoid 350, the pawl catch 360, the ratchet pawl 370, the trip lever 380, and the pawl spring 390 provides the means for preventing the motion of the reel 70 by engagement with the ratchet wheel 71 and allowing free rotation of the reel 70. When the reel 70 is driven in the reel-in direction by the motor, 110 the action of the ratchet wheel 71 on the reel 70 causes the ratchet pawl 370 to move the trip lever 380 into engagement with the pawl catch 360 holding the ratchet pawl 370 out of engagement with the ratchet wheel 71 and allowing free rotation of the reel 70. The solenoid 350 attaches to the main support 55 and is operated by the 12V DC power controlled by the operator. When activated, the solenoid 350 moves the pawl catch 360 to release the ratchet pawl 370 allowing the pawl spring 390 to pull the trip lever 380, which causes the ratchet pawl 370 to engage the ratchet wheel 71. The electronic control unit 60 is located at the driver's station or other designated place determined by the operator and/or driver. It may be connected to the towrope retriever 40 by wire cable or may use radio frequency (RF) signals to control the operation of the towrope retriever 40. The electronic control unit 60 may be a wireless handheld device or may be a integrated wired device secured to the watercraft by Velcro or other temporary or permanent means. Functions of the electronic control unit 60 will be to control on/off of power from the watercraft to the towrope retriever 40, speed and direction of the motor 110, solenoid 350 release of the ratchet pawl 370 for locking the reel 70, and a warning light indicating when the reel 70 can be safely locked. The electronic control unit 60 may include an electric release switch to release the solenoid 350 allowing the towrope 80 to be reeled out when the pull on the towrope 80 exceeds a predetermined clutch setting, an electric-reel in switch to activate the motor 110 in a reel-in direction to disengage the ratchet pawl, 370 an electric lock switch to activate the solenoid 350 to release the ratchet pawl 370 and lock the reel 70, and/or an automatic towrope length adjuster. In other embodiments, there may also be controls to preset the length, and a digital readout of length.

The towrope 80 is a towrope with construction similar to existing ropes, but having no loops except in the ends. The towrope 80 may have length visual length indicators 260, which may be by color, by permanent makings on the towrope 80, by shrink tubing applied to the towrope, or various other means. The towrope 80 is guided through the towrope exit 53 in the main support 55 by the towrope exit guide block 58.

Figure 5A:
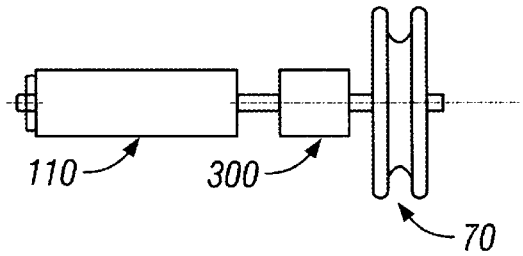
Figure 5B:
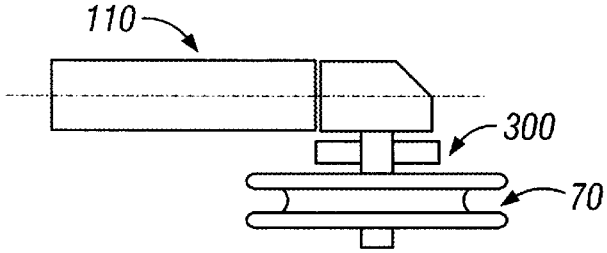
Figure 5C:
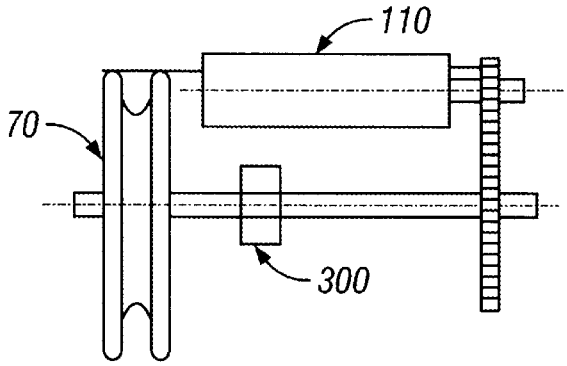

In one alternative embodiment, the direct drive embodiment, the reel 70 is mounted in line with the motor 110 as in FIG. 5A, while in a second alternative embodiment shown in FIG. 5B the reel 70 is mounted at right angles with the motor 110. This second alternative embodiment is known as the right angle gear motor drive. A third alternative embodiment seen in FIG. 5C has the reel 70 mounted on a parallel shaft to the motor 110, which is driven by gears or belts and pulleys. A fourth embodiment features a reel mounted co-axial with the tower 190 or pylon 140 knob 240 or offset from it, while a fifth alternative has a reel mounted with a vertical or horizontal axis of rotation.

Figure 6A:
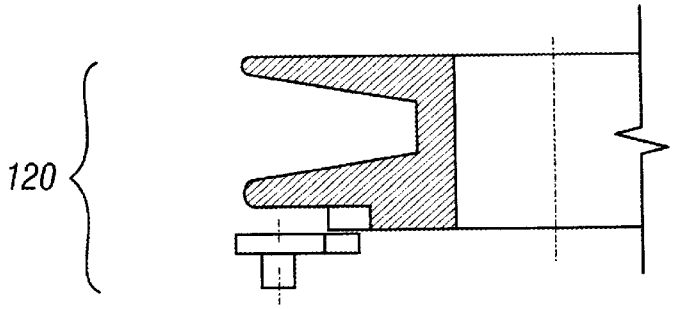
FIGS. 6A–6C and 7A–7B illustrate alternative embodiments of the towrope holding device of the present invention.
Figure 6B:
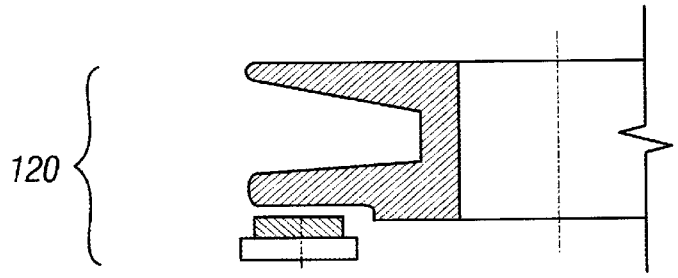
Figure 6C:
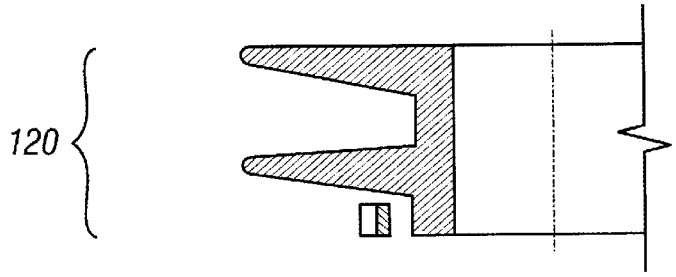
Figure 7A:
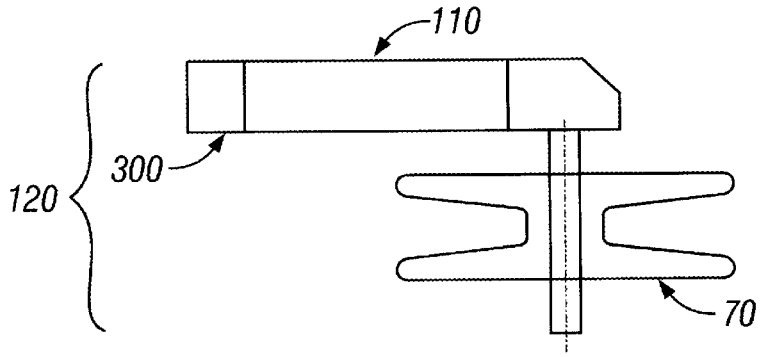
Figure 7B:
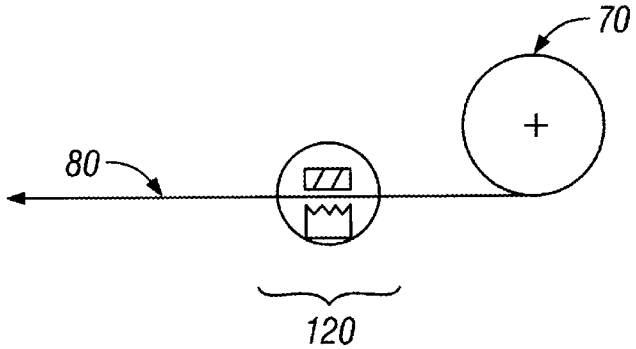

With regard to the towrope holding device 120, one alternative the preferred embodiment features a ratchet approach (FIG. 6A) while a second alternative uses a disk brake approach to hold the towrope (FIG. 6B). In a third alternative shown in FIG. 6C a drum brake approach is used to hold the towrope 80. The fourth alternative uses a motor brake approach (FIG. 7A) while a fifth alternative uses a clamp to hold the towrope 80 as seen in FIG. 7B.

What is claimed is:

1. A towrope retriever system for a watercraft, comprising:

(a) a support unit securely attached to the watercraft for substantially increasing overall height of the watercraft and for increasing acrobatic characteristics of water sport activities by a performer, wherein said watercraft further includes:

i) a bow, ii) a stern, and iii) a starboard gunwale and a port side gunwale located between the bow and the stern, wherein said support unit is a tower being rigidly attached to the starboard gunwale and the port side gunwale;

(b) a towrope retriever comprising:

i) a main housing unit connected to the support unit;

ii) an electronic control unit;

iii) a reel being axially mounted on said main unit and for reeling a towrope having an attachment end attached to said reel and a handle end, said reel being axially mounted in the main housing, and said towrope;

iv) a motor operatively connected to the reel and electrically controlled by the electronic control unit for providing rotational power to the reel; and v) a rope holding device for securely holding the towrope at a selected length.

2. The towrope retriever of claim 1, wherein the motor is capable of forward and reverse operation.

3. The towrope retriever system of claim 1, wherein the motor is adapted to provide reverse torque to hold the towrope in position.

4. The towrope retriever system of claim 1, wherein the motor is capable of variable speed operation.

5. The towrope retriever system of claim 1 wherein the electronic control unit includes an electric speed switch to adjust rotational speed of the motor.

6. The towrope retriever system of claim 1 wherein the electronic control unit includes an electric direction switch to adjust rotational direction of the motor.

7. The towrope retriever system of claim 1, wherein the main housing unit further includes a split collar for rotatably connecting the towrope retriever to a knob on the watercraft.

8. The towrope retriever system of claim 7 further comprising a quick release mechanism allowing easy removal of the towrope retriever from the knob.

9. The towrope retriever system of claim 1 further comprising one or more visual length indicators placed on the towrope, wherein the main housing unit further comprises a measurement reference point for measuring length of the towrope from said measurement reference point to the handle end.

10. The towrope retriever system of claim 1, wherein the electronic control unit is a wireless handheld device.

11. The towrope retriever system of claim 1, wherein said reel is concentrically mounted on the motor, and said system further comprising:

(a) a safety clutch having an input side and an output side, said safety clutch being configured to be driven by the motor on said input side;

(b) a motor-to-spool drive housing being engageably connected to the safety clutch at the output side thereof and fixedly mounted onto the reel for transmitting torque from the motor to the reel; and (c) a ratchet pawl assembly being configured to prevent motion of the reel in a reel-out direction.

12. The towrope retriever system of claim 11, wherein said ratchet pawl assembly comprises:

(a) a solenoid, (b) a pawl catch, (c) a ratchet pawl, (d) a trip lever, and (e) a pawl spring;

such that said ratchet pawl assembly prevents motion of the reel by engagement of said pawl with said ratchet wheel, whereupon the reel being driven by the motor in a reel-in direction, said ratchet moves said trip lever into engagement with said pawl catch and holds said ratchet pawl out of engagement with said ratchet wheel, thereby allowing free rotation of the reel.

13. The towrope retriever system of claim 12, wherein the safety clutch is adapted to slip when torque from the concentric motor or the concentric spool exceeds a predetermined torque setting.

14. The towrope retriever system of claim 13, wherein the electronic control unit includes an electric release switch to release the solenoid, thereby allowing the towrope to be reeled out when pull on said towrope exceeds a predetermined clutch setting.

15. The towrope retriever system of claim 13, wherein the electronic control unit includes an electric reel-in switch to activate the motor in a reel-in direction to disengage said ratchet pawl.

16. The towrope retriever system of claim 13, wherein the electronic control unit includes an electric lock switch to activate said solenoid to release said ratchet pawl, such that the ratchet pawl engages and locks the reel.

17. The towrope retriever system of claim 13, wherein the electronic control unit includes an automatic towrope length adjuster.

18. The towrope retriever system of claim 13 further comprising a towrope length measuring device for measuring a length of the towrope being reeled out.

* * * * *